US006415770B1

(12) United States Patent
Kojima

(10) Patent No.: US 6,415,770 B1
(45) Date of Patent: Jul. 9, 2002

(54) HIGH PRESSURE FUEL SUPPLY SYSTEM AND METHOD

(75) Inventor: Susumu Kojima, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/963,599

(22) Filed: Sep. 27, 2001

(30) Foreign Application Priority Data

Oct. 12, 2000 (JP) ..... 2000-312093

(51) Int. Cl.[7] ..... F02M 37/04
(52) U.S. Cl. ..... 123/511; 123/447
(58) Field of Search ..... 123/495, 446, 123/447, 510–511, 179.16, 179.17

(56) References Cited

U.S. PATENT DOCUMENTS

| | | | | |
|---|---|---|---|---|
| 4,667,638 A | | 5/1987 | Igashira et al. | |
| 5,456,233 A | * | 10/1995 | Felhofer | 123/447 |
| 5,546,912 A | * | 8/1996 | Yamada et al. | 123/511 |
| 5,590,631 A | * | 1/1997 | Tuckey | 123/447 |
| 5,711,263 A | * | 1/1998 | Brown | 123/179.9 |
| 5,809,771 A | * | 9/1998 | Wernberg | 123/447 |
| 5,839,413 A | * | 11/1998 | Krause et al. | 123/447 |
| 5,884,597 A | * | 3/1999 | Hiraku et al. | 123/179.17 |

FOREIGN PATENT DOCUMENTS

| | | |
|---|---|---|
| DE | 100 64 792 A1 | 9/2001 |
| JP | 60-219448 | 11/1985 |
| JP | 5-1646 | 1/1993 |
| JP | 5-1854 | 1/1993 |
| JP | 5-321787 | 12/1993 |
| JP | 7-167009 | 7/1995 |
| JP | 9-170518 | 6/1997 |
| JP | 9-184464 | 7/1997 |
| JP | 9-287532 | 11/1997 |

* cited by examiner

*Primary Examiner*—Thomas Moulis
(74) *Attorney, Agent, or Firm*—Oliff & Berridge PLC

(57) ABSTRACT

A high-pressure fuel supply system and method are used with an internal combustion engine that includes a pressure raising mechanism operable to raise a pressure in a high-pressure portion of the fuel supply system to a level suitable for starting the engine, and a high-pressure pump operable to raise the pressure in the high-pressure portion to a target level that is higher than the above level after the engine is started. When the pressure in the high-pressure portion reaches the level suitable for starting the engine, a pressure wall of the pressure raising mechanism displaces over only a part of its displacement range that ranges from an original position to a maximum displacement position, so that the pressure wall will be able to further displace toward the maximum displacement position so as to raise the pressure in the high-pressure portion when the engine is re-started after the engine is stopped before the pressure wall is returned to the original position.

21 Claims, 6 Drawing Sheets

HIGH PRESSURE FUEL SUPPLY SYSTEM AND METHOD

INCORPORATION BY REFERENCE

The disclosure of Japanese Patent Application No. 2000-312093 filed on Oct. 12, 2000, including the specification, drawings and abstract is incorporated herein by reference in its entirety.

BACKGROUND OF THE INVENTION

1. Field of Invention

The invention relates to a high-pressure fuel supply system and method for supplying high-pressure fuel to be injected into cylinders of an internal combustion engine.

2. Description of Related Art

A high-pressure fuel supply system is known in the art, and is operable to supply high-pressure or pressurized fuel to each of fuel injectors so as to inject the fuel directly into a corresponding one of the cylinders of the internal combustion engine.

A generally known high-pressure fuel supply system includes a delivery chamber that communicates with each of fuel injectors, a high-pressure pump adapted for feeding high-pressure fuel into the delivery chamber under pressure, and a low-pressure pump that is connected to the inlet side of the high-pressure pump so as to ensure entry of the fuel into the high-pressure pump. In general, the low-pressure pump is of an electrically driven type, and is able to start delivering fuel at a rated delivery pressure at the same time that the engine is started. On the other hand, the high-pressure pump is of an engine driven type, and is not able to immediately deliver fuel under pressure in a desired manner upon a start of the engine since the pump is not sufficiently driven by the engine.

It has been proposed to raise the pressure in the delivery chamber to the rated delivery pressure (for example, 0.3 MPa) of the low-pressure pump upon a start of the engine, so as to start fuel injection. However, the rated delivery pressure is considerably lower than a target fuel pressure (for example, 12 MPa) that is to be developed in the delivery chamber during a normal operation of the engine. It is thus difficult to realize desirable fuel injection by utilizing the rated delivery pressure of the low-pressure pump.

To address the above problem, a plunger-type pressure raising mechanism as disclosed in Japanese Laid-open Patent Publication No. 5-321787 has been proposed wherein the pressure in a delivery chamber communicating with fuel injectors is raised to a set pressure upon a start of the engine, by using a plunger that operates at a delivery pressure of the low-pressure pump. Also, an accumulator-type pressure raising mechanism as disclosed in Japanese Laid-open Patent Publication No. 9-184464 has been proposed in which the pressure in a high-pressure pipe is raised to a set pressure upon a start of the engine by using an accumulator in which a fuel pressure developed during an operation of the engine has been accumulated or stored. The plunger of the plunger-type pressure raising mechanism or a diaphragm or piston of the accumulator-type pressure raising mechanism serves as a pressure wall that is caused to displace or move from an original position so as to reduce the volume of a high-pressure portion of the fuel supply system that is located downstream of the high-pressure pump. If the high-pressure pump starts being sufficiently driven by the engine, and the pressure in the high-pressure portion becomes higher than the set pressure, the pressure wall as described above is returned to the original position due to the high pressure of the fuel delivered by the high-pressure pump.

If the pressure in the high-pressure portion of the fuel supply system is raised by the pressure raising mechanism to be almost equal to the set pressure for starting, the engine exhibits good starting characteristics. However, the pressure wall of the pressure raising mechanism does not always operate normally or fulfill its intended function. If the pressure wall does not operate normally, the engine starting characteristics may deteriorate, and a large quantity of unburned fuel may be discharged from the cylinders. Since a catalyst device of an exhaust system of the engine is not sufficiently activated during a starting period of the engine, the large quantity of unburned fuel thus discharged may be released to the atmosphere without being purified or removed.

SUMMARY OF THE INVENTION

It is therefore an object of the invention to provide a high-pressure fuel supply system and method for supplying fuel into cylinders of an internal combustion engine, which includes a pressure raising mechanism that is adapted to raise a pressure in a high-pressure portion of the fuel supply system to a suitable set pressure upon a start of the engine, by displacing or moving a pressure wall so as to reduce the volume of the high-pressure portion, wherein the pressure wall is prevented in advance from operating in an undesirable manner.

To accomplish the above and/or other objects, there is provided according to a first aspect of the invention a high-pressure fuel supply system for an internal combustion engine, comprising: (a) a pressure raising mechanism and (b) a high-pressure pump. The pressure raising mechanism is operable to raise a pressure in a high-pressure portion of the fuel supply system to a first level during a start of the internal combustion engine. The pressure raising mechanism includes a pressure wall that is displaceable from an original position so as to reduce a volume of the high pressure portion and thereby raise the pressure in the high-pressure portion. The pressure wall is displaceable in a predetermined displacement range between the original position and a maximum displacement position. The high-pressure pump is operable to raise the pressure in the high-pressure portion of the fuel supply system to a second level that is higher than the first level after the start of the internal combustion engine. The pressure wall is returned to the original position when the pressure in the high-pressure portion is raised by the high-pressure pump to the second level. In the high-pressure fuel supply system, the pressure wall is spaced apart from the maximum displacement position of the predetermined displacement range when the pressure in the high-pressure portion that is raised by the pressure raising mechanism reaches the first level, so that the pressure wall will be able to further displace toward the maximum displacement position so as to raise the pressure in the high-pressure portion when the internal combustion engine is re-started after the engine is stopped before the pressure wall is returned to the original position. The high-pressure fuel supply system of this aspect of the invention, constructed as described above, is able to assure good engine starting characteristics.

According to a second aspect of the invention, the pressure raising mechanism is operable to raise a pressure in a high-pressure portion of the fuel supply system to a first level during a start of the internal combustion engine. The pressure raising mechanism includes a pressure wall that is displaceable from an original position so as to reduce a volume of the high-pressure portion and thereby raise the pressure in the high-pressure portion. The pressure wall is displaceable in a predetermined displacement range between the original position and a maximum displacement position. The high-pressure pump is operable to raise the pressure in the high-pressure portion of the fuel supply system to a second level that is higher than the first level after the start of the internal combustion engine. The pressure wall is returned to the original position when the pressure in the high-pressure portion is raised by the high-pressure pump to the second level. In this high-pressure fuel supply system, a controller diagnoses the pressure raising mechanism based on changes in the pressure in the high-pressure portion during an operation of the high-pressure pump. With this arrangement, the pressure raising mechanism, such as a plunger or an accumulator, can be immediately repaired upon determination of an abnormality or a failure therein, so that the pressure wall can operate normally, thus assuring good engine starting characteristics.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENTS

Figure 1:
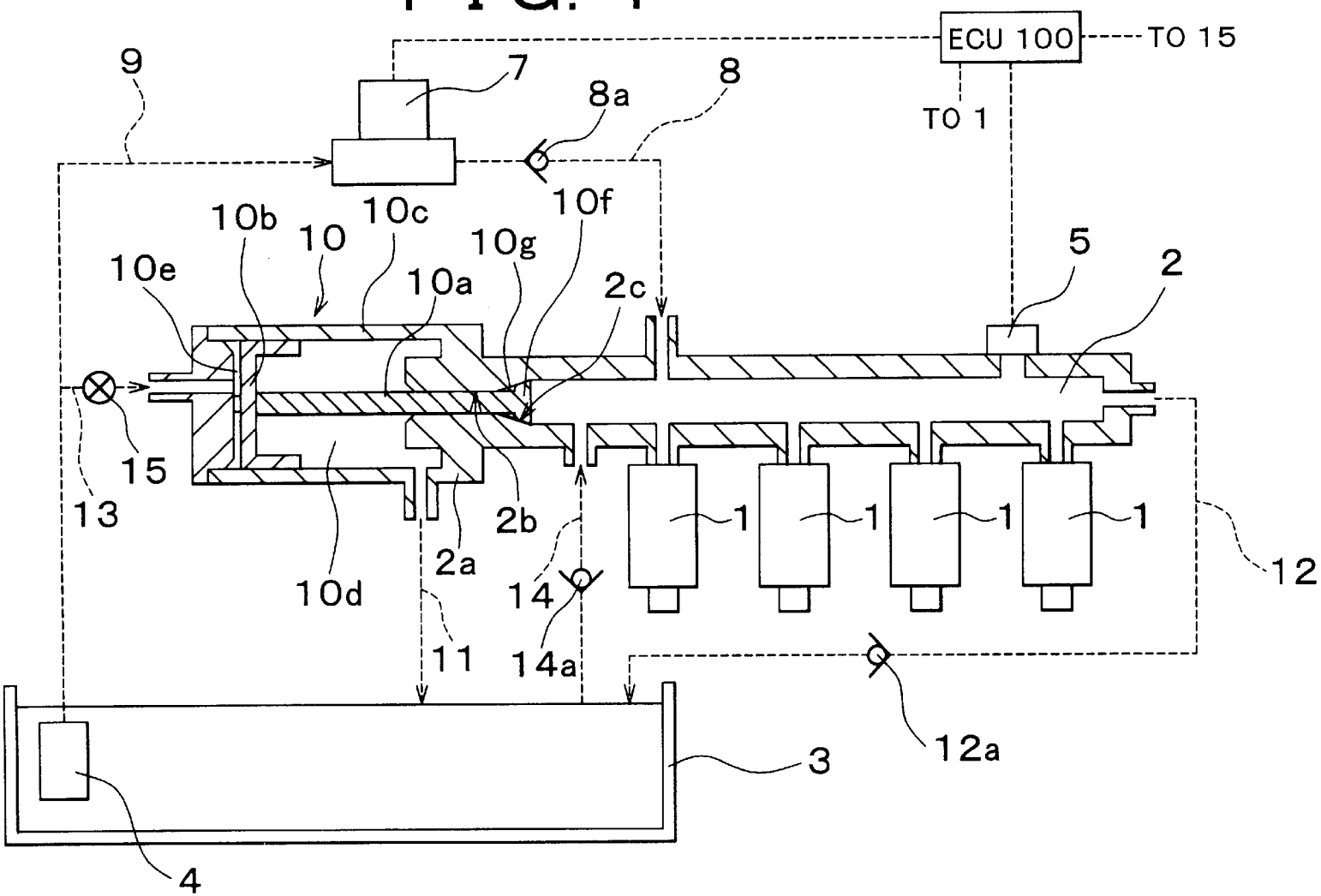
FIG. 1 is a view schematically showing a high-pressure fuel supply system for supplying high-pressure fuel to be injected into cylinders of an internal combustion engine according to a first embodiment of the invention.

FIG. 1 schematically shows a high-pressure fuel supply system for supplying fuel into cylinders of an internal combustion engine, which system is constructed according to a first preferred embodiment of the invention. While the internal combustion engine has four cylinders in the preferred embodiment, the high-pressure fuel supply system according to the invention may be employed in other types of internal combustion engine. In FIG. 1, four fuel injectors 1 are provided for respective cylinders of the engine. A delivery chamber 2 is provided for supplying high-pressure fuel to each of the fuel injectors 1. The delivery chamber 2 is provided with a pressure sensor 5 that serves to detect a fuel pressure within the delivery chamber 2. Each of the fuel injectors 1 includes a valve member (not shown) for opening and closing an injector nozzle or hole, and a solenoid (not shown) that attracts the valve member in a valve-opening direction so that fuel is sprayed through the injector nozzle. The valve member normally receives a biasing force of a spring and a fuel pressure in the delivery chamber 2, which are applied in a valve-closing direction. When the solenoid is in a non-energized state, the injector nozzle is surely or reliably closed by the valve member, and fuel is inhibited from being injected from the fuel injector 1. When the solenoid is energized, the solenoid attracts the valve member in the valve-opening direction against the spring force and the fuel pressure in the delivery chamber 2, so that the fuel is injected from the fuel injector 1.

A low-pressure pump 4 is disposed in a fuel tank 3. The low-pressure pump 4 is an electric pump that is driven with electric power supplied by a battery, and is able to deliver fuel at a rated pressure of, for example, 0.3 MPa. The low-pressure pump 4 is activated at the same time that an ON signal is generated from a starter switch, namely, the starter switch is turned on. A filter (not shown) for removing foreign matters introduced along with the fuel from the fuel tank 3 is provided on the inlet side of the low-pressure pump 4.

A high-pressure pump 7 is provided for maintaining the fuel pressure in the delivery chamber 2 at around a target fuel pressure of, for example, 12 MPa. The high-pressure pump 7 is of an engine-driven type, and has a plunger that is driven by a cam coupled to a crankshaft of the engine. The high-pressure pump 7 is adapted to deliver or feed the fuel at an elevated pressure. In this embodiment, the delivery stroke of the high-pressure pump 7 takes place for each fuel injection into two cylinders.

The delivery side or outlet of the high-pressure pump 7 is connected to the delivery chamber 2 via a high-pressure pipe 8, and the entry side or inlet of the high-pressure pump 7 is connected to the delivery side (i.e., outlet) of the low-pressure pump 4 via a low-pressure pipe 9. Since the pressure of fuel that is fed from the low-pressure pipe 9 during the intake stroke of the high-pressure pump 7 has been raised to 0.3 MPa by the low-pressure pump 4 as described above, fuel vapor is less likely to occur due to a negative pressure or a vacuum in the low-pressure pipe 9. The high-pressure pipe 8 is provided with a check valve **8*a* that is adapted to open at a set pressure so as to prevent the fuel from flowing in the reverse direction due to pressure pulsation caused by the high-pressure pump 7**.

The high-pressure pump 7 adjusts the quantity of fuel to a required level so that the fuel pressure in the delivery chamber 2 is controlled to the target fuel pressure, and delivers the adjusted quantity of fuel under pressure. At the same time, an unnecessary portion of the fuel delivered by the plunger of the high-pressure pump 7 is returned to the fuel tank 3 via the low-pressure pipe 9. It is, however, undesirable that the high-pressure fuel flows through the low-pressure pump 4 in the reverse direction. In view of this situation, a safety valve adapted to open at a pressure that is slightly higher than the rated delivery pressure of the low-pressure pump 4 may be provided such that the low-pressure pipe 9 communicates with the fuel tank 3 via the safety valve.

In order to prevent the fuel pressure within the delivery chamber 2 from being excessively elevated for some reason, a return pipe 12 is provided for communicating the delivery chamber 2 with the fuel tank 3. In addition, a safety valve **12*a* adapted to open at a fuel pressure that is slightly higher than the target fuel pressure may be provided midway in the return pipe 12. With the return pipe 12 thus provided, the high-pressure pump 7 may always feed all of the fuel delivered by the plunger, to the delivery chamber 2**, without adjusting the quantity of the fuel.

In any event, if the high-pressure pump 7 is in a good operating condition after a start of the engine, the pressure in the delivery chamber 2 can be maintained at around the target fuel pressure, and desirable fuel injection through the fuel injectors 1 can be accomplished. However, the high-pressure pump 7, which is of the engine-driven type, is not in a good operating condition during low-speed rotation of the engine by a starter motor. Thus, the high-pressure pump 7 cannot immediately raise the pressure in the delivery chamber 2, which has been lowered approximately to the atmospheric pressure, to the target fuel pressure, in an early starting period of the engine.

In the meantime, the low-pressure pump 4, which is of an electrically driven type, is in a good operating condition upon a start of the engine, and is thus able to feed fuel at a rated delivery pressure, so that the pressure in the delivery chamber 2 is raised to the rated delivery pressure of the low-pressure pump 4 in an early starting period of the engine. However, the rated delivery pressure of the low-pressure pump 4 is considerably lower than the target fuel pressure as described above, and it is difficult to inject fuel at the rated delivery pressure in a desired spray form. Furthermore, due to this initial, low pressure delivered by pump 7, the fuel injection valve of the fuel injector 1 needs to be opened for an increased period of time so as to inject a required quantity of fuel, thus making it difficult to perform fuel injection in desired timing.

The high-pressure fuel supply system of the first embodiment has a pressure raising mechanism 10 for raising the fuel pressure in the delivery chamber 2 to a level higher than the rated delivery pressure of the low-pressure pump 4 upon a start of the engine. The pressure raising mechanism 10 includes a small-area plunger 10*a* that extends through a hole 2*b* formed in a large-thickness wall portion 2*a* that partially defines the delivery chamber 2, such that the plunger 10*a* may project into the delivery chamber 2 by a variable length. The small-area plunger 10*a* has a uniform circular cross section having a diameter that is slightly smaller than that of the hole 2*b*, and is able to slide along the wall of the hole 2*b*. The pressure raising mechanism 10 further includes a large-area plunger 10*b* that is located outwardly of the delivery chamber 2 and has a uniform cross section that is significantly larger than the cross section of the small-area plunger 10*a*. The large-area plunger 10*b* is provided for pressing the small-area plunger 10*a* so as to increase the length by which the plunger 10*a* projects into the delivery chamber 2.

The large-area plunger 10*b* is slidable in a bore of a cylinder 10*c* that is formed integrally with the wall portion 2*a* as indicated above. While the small-area plunger 10*a*, the hole 2*b* slidably receiving the plunger 10*a*, the large-area plunger 10*b* and the cylinder 10*c* slidably receiving the plunger 10*b* have circular cross sections, these components may have any other cross-sectional shape provided that the plungers 10*a*, 10*b* are respectively slidable along the hole 2*b* and the cylinder 10*c*. The large-area plunger 10*b* is formed in a cylindrical shape with a bottom at its one end remote from the wall portion 2*a* (i.e., in a U-like shape as shown in FIG. 1), for the sake of reducing its weight, and an end face of the small-area plunger 10*a* abuts on the bottom of the thus formed large-area plunger 10*b*. Since the large-area plunger 10*b* is only required to press the small-area plunger 10*a* as will be described in detail later, the large-area plunger 10*b* and the small-area plunger 10*a* need not be formed integrally with each other. If the large-area plunger 10*b* and the small-area plunger 10*a* are formed separately from each other, there is no need to align (i.e., make co-axial) the center axis of the cylinder 10*c* slidably receiving the large-area plunger 10*b* with the center axis of the hole 2*b* slidably receiving the small-area plunger 10*a*, provided that these center axes are parallel with each other. In this case, the cylinder 10*c* and the hole 2*b* can be easily formed by machining.

Figure 4:
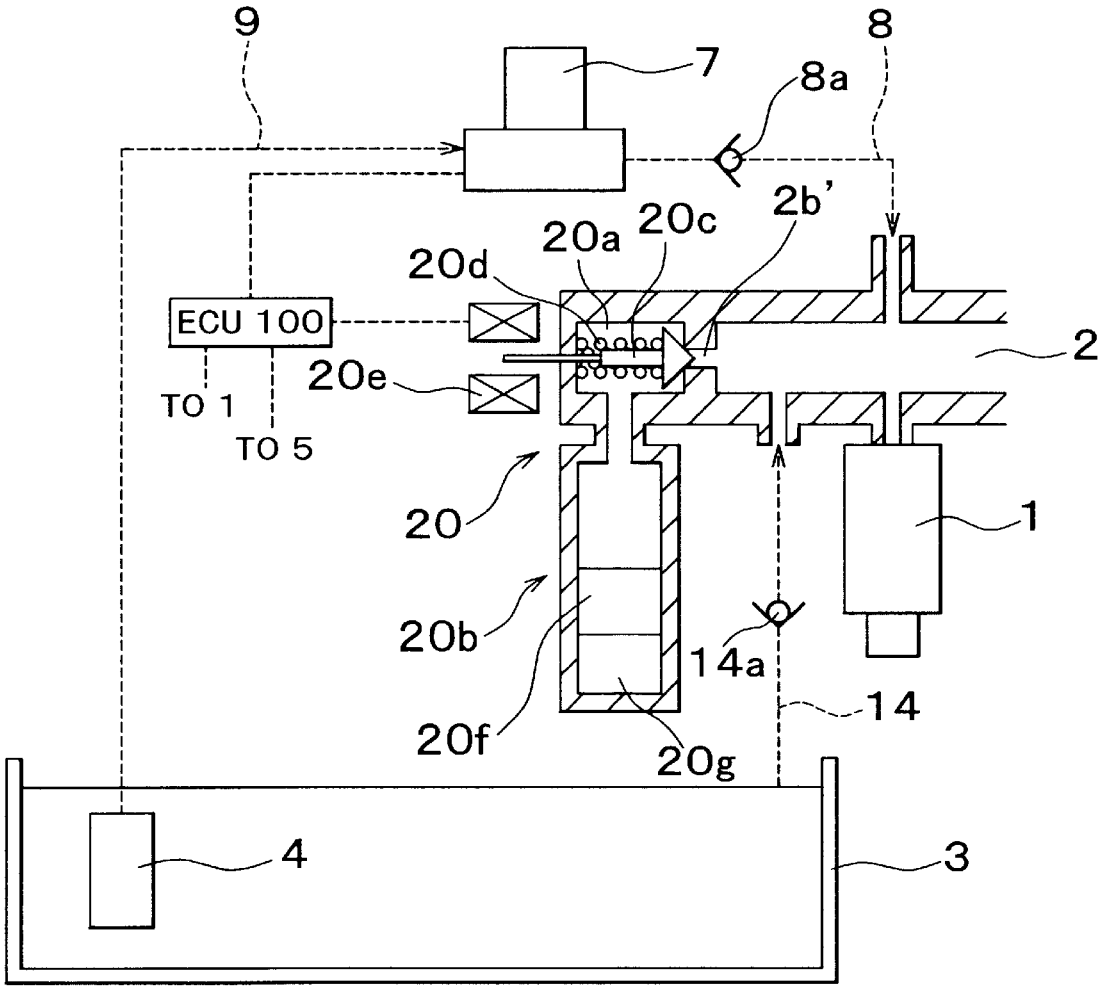
FIG. 4 is a view schematically showing a high-pressure fuel supply system for supplying high-pressure fuel to be injected into cylinders of an internal combustion engine according to a second embodiment of the invention.

The space in the cylinder 10*c* is divided by the large-area plunger 10*b* into two chambers, one of which containing the small-area plunger 10*a* is an atmosphere chamber 10*d*, and the other of which is a pressure chamber 10*e*. The atmosphere chamber 10*d* communicates with the fuel tank 3 through a return pipe 1. On the other hand, the pressure chamber 10*e* communicates with the low-pressure pipe 9 through a branch pipe 13. A control valve 15 is disposed in the branch pipe 13. The large-area plunger 10*b* is displaceable or movable between an original position in which the plunger 10*b* abuts on an end wall of the cylinder 10*c* remote from the wall portion 2*a*, and a maximum displacement position in which the plunger 10*b* abuts on the wall portion 2*a* of the delivery chamber 2. Namely, the large-area plunger 10*b* has a displacement range between the original position and the maximum displacement position. The small-area plunger 10*a* that moves with the large-area plunger 10*b* has substantially the same displacement range as that of the large-area plunger 10*b*. The structure of the control valve 15 is similar to that of a valve device of a pressure raising mechanism 20 of the second embodiment as shown in FIG. 4. As described in detail later, the control valve 15 normally serves as a check valve for only permitting flow of fuel from the pressure chamber 10*e* into the low-pressure pipe 9. By energizing a solenoid, or the like, the control valve 15 can be forcibly opened, so that the fuel is allowed to flow from the low-pressure pipe 9 to the pressure chamber 10*e*.

Figure 2:
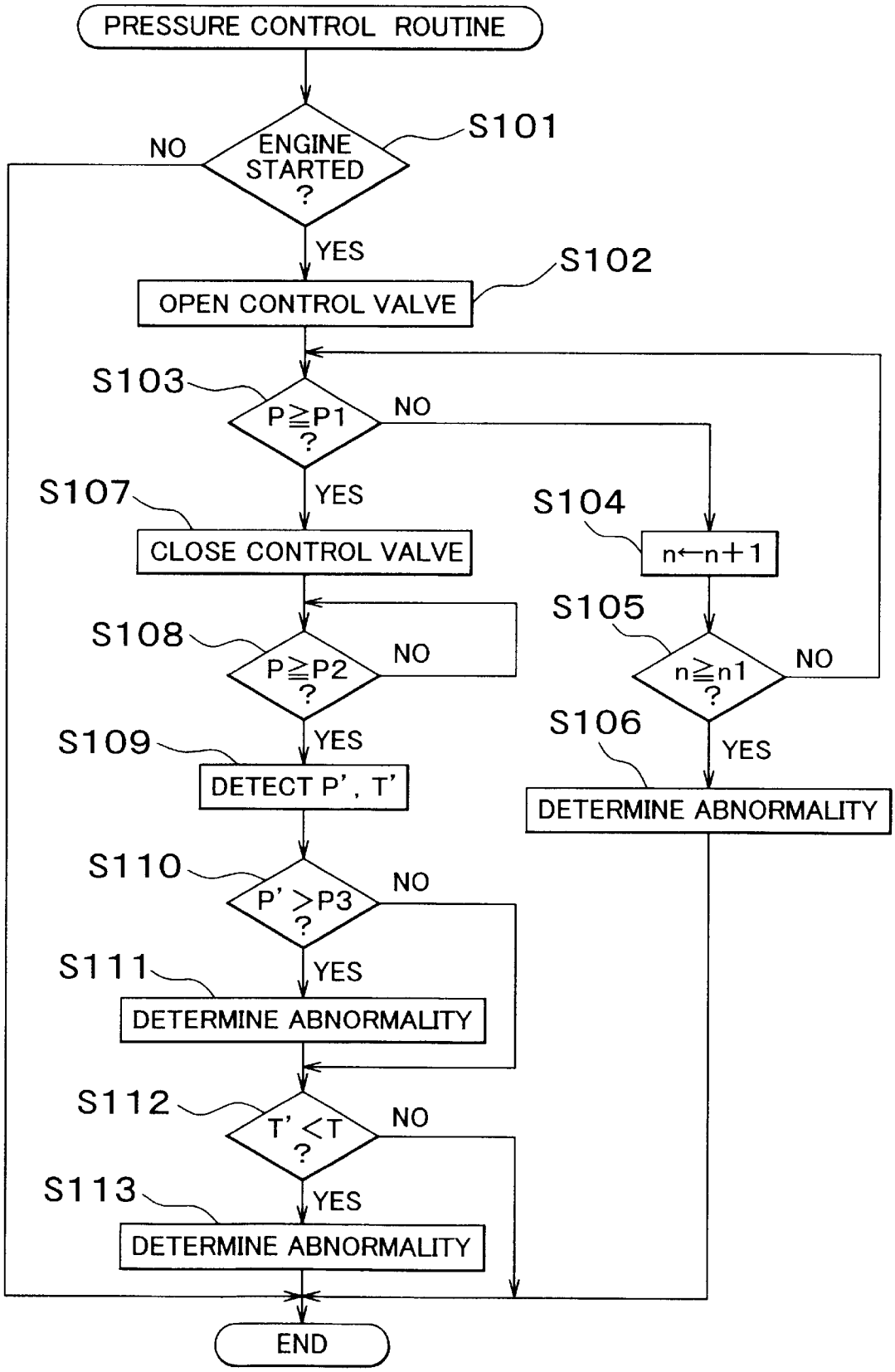
FIG. 2 is a flowchart illustrating a pressure control routine implemented by the high-pressure fuel supply system of the first embodiment of FIG. 1.

The high-pressure fuel supply system constructed as described above is controlled upon a start of the engine, according to a pressure control routine as illustrated in FIG. 2. In step 101, it is determined whether the internal combustion engine has been started, depending upon the presence of an ON signal of the ignition switch. If a negative decision (NO) is obtained in step 101, the current cycle of the control routine is terminated. If an affirmative decision (YES) is obtained in step 101, the solenoid of the control valve 15 is energized so that the control valve 15 is forcibly opened in step 102. With the low-pressure pump 4 having been operated since the ignition switch is turned on, the rated delivery pressure of the low-pressure pump 4 is applied to the pressure chamber 10*e* through the branch pipe 13. As a result, the large-area plunger 10*b* moves from the original position toward the wall portion 2*a*, thereby to press and move the small-area plunger 10*a* so that the small-area plunger 10*a* projects into the delivery chamber 2 by an increased length. Thus, the volume of a high-pressure portion of the fuel supply system that is located downstream of the high-pressure pump 7 (or downstream of the check valve 8*a* when the valve 8*a* is provided on the delivery side of the pump 7) is reduced by an amount corresponding to the increase in the projection length of the small-area plunger 10*a*. Accordingly, the fuel in the high-pressure portion is compressed, and its pressure is raised to a level that is higher than the rated delivery pressure of the low-pressure pump 4. Thus, the end face of the small-area plunger 10*a* functions as a pressure wall for raising the pressure of the fuel in the high-pressure portion of the fuel supply system.

In step 103, it is determined whether the thus raised fuel pressure P in the high-pressure portion, which is detected by the pressure sensor 5, has reached a set pressure P1 that should be established upon a start of the engine. The set pressure P1 will be hereinafter called "set starting pressure P1". If a negative decision (NO) is obtained in step 103, control proceeds to step 104 to increment the count value n that was reset to zero when the engine was last stopped. In the next step 105, it is determined whether the count value n has reached a set period n1. If a negative decision (NO) is obtained in step 105, control returns to step 103. If the pressure raising mechanism 10 operates normally, the fuel pressure P in the high-pressure portion of the fuel supply system reaches the set starting pressure P1 before the count value n reaches the set period n1. If an affirmative decision (YES) is obtained in step 103, the solenoid of the control valve 15 is de-energized so that the control valve 15 is closed in step 107.

The small-area plunger 10*a* and the large-area plunger 10*b* are arranged to displace or move over only about a half of the entire displacement range, at a point of time when the fuel pressure P in the high-pressure portion reaches the set pressure P1. In the pressure raising mechanism of the first embodiment, the pressure (applied to the fuel in the delivery chamber 2) obtained by multiplying the delivery pressure of the low-pressure pump 4 by the ratio of the cross-sectional area of the large-area plunger 10*b* to that of the small-area plunger 10*a* is higher than the set pressure P1. By closing the control valve 15 at an appropriate point of time, the fuel pressure in the high-pressure portion can be controlled to be equal to the set pressure P1. Needless to say, the applied pressure obtained by multiplying the delivery pressure of the low-pressure pump 4 by the ratio of the cross-sectional area of the large-area plunger 10*b* to that of the small-area plunger 10*a* may be made substantially equal to the set pressure P1, and the small-area plunger 10*a* is arranged to move over about a half of the displacement range when the fuel pressure in the high-pressure portion becomes equal to the set pressure P1. In this case, there is no particular need to provide the control valve 15 in the branch pipe 13.

In the above-described manner, the fuel pressure in the high-pressure portion of the fuel supply system is raised to the set pressure P1 that is considerably higher than the rated delivery pressure of the low-pressure pump 4. With the fuel pressure thus sufficiently raised, the fuel supply system can realize desirable fuel injection upon a start of the engine, thus assuring a highly reliable engine start. As the engine speed then increases after the start of the engine, the high-pressure pump 7 is brought into a relatively good operating condition, so that the fuel pressure in the high-pressure portion is further increased, and is maintained at around a target fuel pressure P2.

Figure 3:
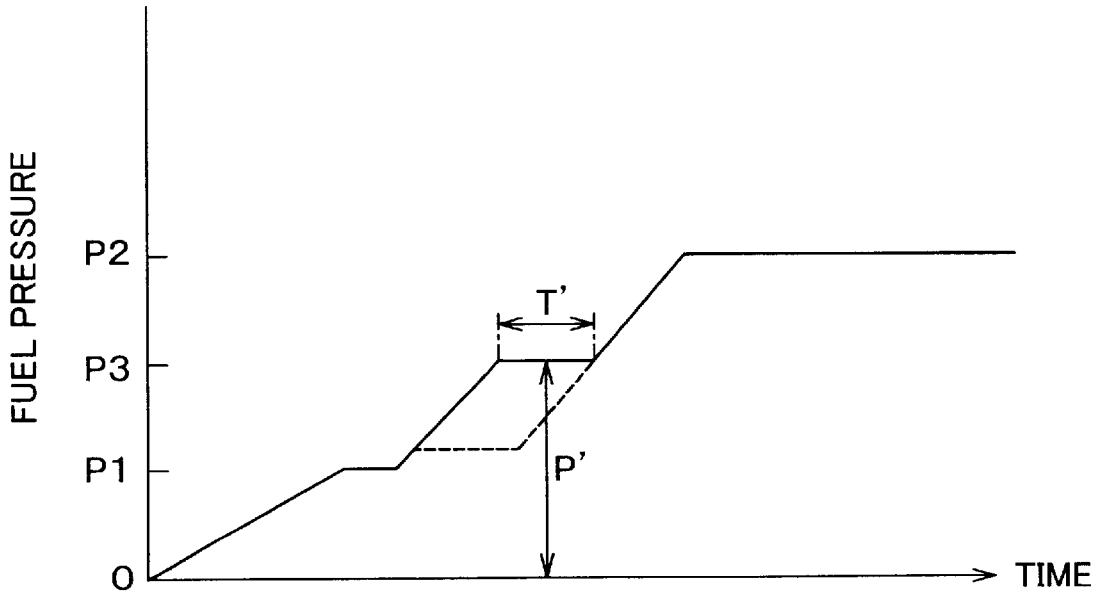
FIG. 3 is a time chart showing pressure changes in a high-pressure portion of the high-pressure fuel supply system of the first embodiment when the engine is started.

If the fuel pressure P reaches the target fuel pressure P2, an affirmative decision (YES) is obtained in step 108, and an actual return pressure P' and an actual return period T' (which will be described later) are detected in step 109. FIG. 3 is a time chart showing changes in the fuel pressure P in the high-pressure portion of the fuel supply system during a starting period of the engine. The fuel pressure P is raised to the set pressure P1 by the pressure raising mechanism 10, and is then gradually raised to the target fuel pressure P2 by the high-pressure pump 7 that is driven in accordance with the operation of the engine. During the time in which the fuel pressure P is raised from the set pressure P1 to the target fuel pressure P2, there exists a period in which the fuel pressure P does not increase (or is kept at a certain level). This period is the above-indicated return period T', and the fuel pressure P established during this period is the above-indicated return pressure P'.

If the pressure raising mechanism 10 operates normally, the small-area plunger 10*a* and the large-area plunger 10*b* of the pressure raising mechanism 10 are returned to their original positions while the fuel pressure P is kept at a set return pressure P3. However, if the engine is stopped before the fuel pressure P in the high-pressure portion reaches the set return pressure P3, the small-area plunger 10*a* and the large-area plunger 10*b* are kept at their current positions without being returned to their original positions, and the fuel pressure in the high-pressure portion is lowered to the atmospheric pressure. If this occurs, however, the small-area plunger 10*a* and the large-area plunger 10*b* of the pressure raising mechanism 10 of this embodiment still are able to displace over the remaining portion (about a half) of the displacement range. Therefore, when the low-pressure pump 4 is activated and the control valve 15 is opened upon a re-start of the engine while the small-area plunger 10*a* and the large-area plunger 10*b* are placed at approximately middle positions in the displacement ranges, the small-area plunger 10*a* is moved in a similar manner as described above, and the fuel pressure in the high-pressure portion can be raised to about the set pressure P1, thus assuring good engine starting characteristics.

In the present embodiment, the set return pressure P3 is equal to a predetermined pressure that is higher than the above-indicated pressure based on the ratio of the areas of the large-area plunger 10*b* and small-area plunger 10*a* of the pressure raising mechanism 10, by an amount corresponding to the friction forces generated at sliding portions of the large-area plunger 10*b* and small-area plunger 10*a*. If the fuel pressure P in the high-pressure portion becomes equal to the predetermined pressure, the fuel pressure in the pressure chamber 10*e* of the pressure raising mechanism 10 becomes higher than the delivery pressure of the low-pressure pump 4, thereby opening the control valve 15 as a check valve. As a result, the fuel in the pressure chamber 10*e* is returned to the fuel tank 3 via the low-pressure pipe 9. In this manner, the small-area plunger 10*a* and the large-area plunger 10*b* are returned to their original positions.

In step 110, it is determined whether the actual return pressure P' is higher than the set return pressure P3. An affirmative decision (YES) in step 110 indicates the presence of a problem, such as an increase in the frictional force generated upon sliding of the small-area plunger 10*a* or the large-area plunger 10*b*. In this case, step 111 is executed, thereby determining that the pressure raising mechanism 10 is in an undesirable or abnormal operating condition, and generating an alarm to the driver. It is then determined in step 112 whether the actual return period T' is shorter than the set return period T. An affirmative decision (YES) in step 112 also indicates the presence of a problem, for example, that the small-area plunger 10*a* or the large-area plunger 10*b* stick to the inner wall of the hole 2*b* or the cylinder 10*c* when they return to their original positions. In this case, step 113 is executed, thereby determining that the pressure raising mechanism 10 is in an undesirable or abnormal operating condition, and generating an alarm to the driver. Also, if an affirmative decision (YES) is obtained in step 105, namely, if the fuel pressure in the high-pressure portion does not reach the set pressure P1 within the set period n1, that indicates the presence of a problem in the pressure raising mechanism 10, for example, an excessive increase in the frictional force upon sliding of the small-area plunger 10*a* or the large-area plunger 10*b*, or sticking of the small-area plunger 10*a* or large-area plunger 10*b* to the corresponding wall. In this case, step 106 is executed, thereby determining that the pressure raising mechanism 10 is in an undesirable or abnormal operating condition, and generating an alarm to the driver.

When the pressure raising mechanism 10 is designed such that the pressure obtained by multiplying the delivery pressure of the low-pressure pump 4 by the ratio of the cross-sectional area of the large-area plunger 10*b* to that of the small-area plunger 10*a* is made equal to the set pressure P1 as described above, the return pressure P3 is higher than the set pressure P1 only by the frictional forces of the large-area plunger and the small-area plunger, as indicated by a broken line in FIG. 3, thus permitting a similar diagnosis of the pressure raising mechanism. In this case, too, when the small-area plunger and the large-area plunger return to the original positions, the fuel in the pressure chamber 10*e* is returned to the fuel tank 3 via the low-pressure pipe 9.

In the present embodiment, when the engine is re-started after it was stopped before the small-area plunger serving as a pressure wall of the pressure raising mechanism was returned to the original position, the small-area plunger is allowed to normally displace from its current position, which is different from the original position. Furthermore, the pressure raising mechanism can be diagnosed in the manner as described above, and an undesirable or abnormal operation of the small-area plunger can be avoided in advance through repair, or the like. The routine illustrated by the flowchart of FIG. 2 is executed by an engine control unit(ECU) 100, and thus the ECU 100 functions to perform the above-described diagnoses. The ECU 100 includes, e.g., RAM, ROM and a CPU, etc.

In the present embodiment, no sealing member that gives large frictional force during sliding movements is provided between the small-area plunger 10*a* and the inner wall of the hole 2*b* and between the large-area plunger 10*b* and the inner surface of the cylinder 10*c*, and therefore smooth movements of the small-area plunger 10*a* and the large-area plunger 10*b* can be achieved. In the absence of such sealing members, the fuel in the pressure chamber 10*e* may leak into the atmosphere chamber 10*d* through a clearance between the large-area plunger 10*b* and the cylinder 10*c*. Nevertheless, the pressure in the pressure chamber 10*e* is normally equal to the rated delivery pressure of low-pressure pump 4, which is relatively low, and therefore almost no fuel leakage occurs provided that the size of this clearance is suitably selected. There is also a possibility that the fuel in the high-pressure portion leaks into the atmosphere chamber 10*d* through a clearance between the small-area plunger 10*a* and the inner wall of the hole 2*b* when the pressure in the high-pressure portion is raised to the set pressure P1 by means of the pressure raising mechanism 10. At this time, however, the pressure level (the set pressure P1) is considerably lower than the target fuel pressure of the high-pressure portion, and it is therefore possible to mostly prevent fuel leakage by suitably selecting the size of the clearance between the small-area plunger 10*a* and the inner wall of the hole 2*b*.

Even if a slight amount of fuel leaks from the pressure chamber 10*e* or the high-pressure portion into the atmosphere chamber 10*d*, the leakage fuel is returned to the fuel tank 3 due to gravity, through a return pipe 11 that communicates the atmosphere chamber 10*d* with the fuel tank 3. Thus, no particular problem arises from the fuel leakage.

When the high-pressure pump 7 normally operates after the start of the engine, and the fuel pressure within the high-pressure portion is increased to be close to the considerably high target fuel pressure, fuel is highly likely to leak through the clearance between the small-area plunger 10*a* and the inner wall of the hole 2*b* if no sealing is provided at the clearance. In order to prevent such fuel leakage, an extended portion 10*f* having a truncated conical shape is formed at an end portion of the small-area plunger 10*a* located in the high-pressure portion, concentrically with the plunger 10*a*, and an O ring 10*g* serving as a seal member is fitted in an annular groove formed in the extended portion 10*f* about its axis.

When the fuel pressure in the high-pressure portion becomes equal to the return pressure as described above, and the small-area plunger 10*a* and large-area plunger 10*b* return to their original positions, the O ring 10*g* is compressed, and adheres to the inner surface 2*c* of the wall portion 2*a* while adhering to the wall of the entire groove of the extended portion 10*f*. Thus, the hole 2*b* is sealed, and the fuel leakage as described above can be avoided.

During operations of the engine, the temperature of the fuel within the high-pressure portion downstream of the high-pressure pump 7 is usually lower than the temperature of a delivery pipe defining the delivery chamber 2, since new fuel is sequentially supplied from the fuel tank 3 into the delivery chamber 2. After the engine is stopped, no fuel is supplied from the fuel tank 3, and therefore the temperature of the fuel in the high-pressure portion becomes substantially equal to that of the delivery pipe. Thus, immediately after the engine is stopped, the fuel in the delivery chamber receives heat from the delivery pipe, resulting in an increase in the fuel temperature and thermal expansion of the fuel. As a result, the safety valve 12*a* of the return pipe 12 is activated, and the fuel pressure in the delivery chamber is maintained at around the target fuel pressure.

After a while, the temperatures of the delivery pipe and the fuel in the delivery chamber are gradually lowered down to the ambient air temperature. At this time, the fuel is subjected to a greater degree of thermal shrinkage than the delivery pipe, due to a difference in the coefficient of thermal expansion between the delivery pipe and the fuel. In a conventional fuel supply system, the fuel pressure becomes negative at this time, and fuel vapor arises in the high-pressure portion downstream of the high-pressure pipe 7. In this condition, if the pressure raising mechanism as described above is activated as described above upon a start of the engine, the operation (or movement) of the small-area plunger 10*a* only results in eliminating the fuel vapor in the high-pressure portion. Thus, the pressure raising mechanism does not raise the pressure in the high-pressure portion to the set pressure as indicated above.

To solve the above problem, the high-pressure fuel supply system of the present embodiment is designed such that the high-pressure portion communicates with the fuel tank 3 via a communication tube 14, and a check valve 14*a* is provided in the communication tube 14, for only permitting flow of the fuel from the fuel tank 3 to the high-pressure portion. The check valve 14*a* is easily opened in the presence of a slight pressure difference. With this arrangement, if the fuel pressure in the high-pressure portion becomes lower than the atmospheric pressure after the engine is stopped, the check valve 14*a* is opened, and the fuel flows from the fuel tank 3 into the high-pressure portion through the communication pipe 14. Thus, the pressure in the high-pressure portion is prevented from becoming negative, and therefore no fuel vapor forms in the high-pressure portion. Thus, the pressure raising mechanism is surely able to raise the pressure in the delivery chamber to a sufficiently high level at the time of the start of the engine.

FIG. 4 schematically shows a high-pressure fuel supply system for supplying fuel to be injected into cylinders of an internal combustion engine according to a second preferred embodiment of the invention. In FIG. 4, the same reference numerals as used in FIG. 1 are used for identifying structurally and/or functionally corresponding elements. In the following description, only differences between the first and second embodiments will be described. A pressure raising mechanism 20 of this embodiment is of an accumulator type, rather than of a plunger type. More specifically, the pressure raising mechanism 20 includes a control chamber 20*a* that communicates with an opening 2*b*' of the high-pressure portion of the fuel supply system, and an accumulator 20*b* that communicates with the control chamber 20*a*. The control chamber 20*a* houses a valve member 20*c* that is able to close the opening 2*b*', and a spring 20*d* that biases the valve member 20*c* in the valve-closing direction such that the opening 2*b*' is normally closed by the valve member 20*c*. The valve member 20*c* has a rod that fluid-tightly extends outwardly of the control chamber 20*a,* and a solenoid 20*e* is disposed around the rod. The accumulator 20*b* includes a piston 20*f* that cooperates with a housing of the accumulator 20*b* to define a pressure chamber 20*g*. The pressure chamber 20*g* fluid-tightly closed by the piston 20*f* is filled with gas, such as nitrogen, at a set pressure P1. While the accumulator of this embodiment uses the piston 20*f* for partially defining the pressure chamber 20*g,* the piston may be replaced by a diaphragm that is able to be elastically deformed.

With the above-described arrangement, if the pressure in the high-pressure portion of the high-pressure fuel supply system becomes sufficiently high during an operation of the engine, the valve member 20*c* is easily brought into its open position (i.e., the opening 2*b*' is opened), and the pressure within the control chamber 20*a* becomes equal to the pressure within the high-pressure portion. This pressure is then applied to the piston 20*f,* and nitrogen gas contained in the pressure chamber 20*g* is compressed so that the pressure of the nitrogen gas becomes equal to that in the control chamber 20*a* (or in the high-pressure portion). If the pressure in the high-pressure portion is slightly reduced, the opening 2*b*' is closed by the valve member 20*c*. When the engine is then stopped, the pressure chamber 20*g* of the accumulator 20*b* is maintained at around the target fuel pressure achieved during the operation of the engine, and at the same time the piston 20*f* is located at an original position.

Figure 5:
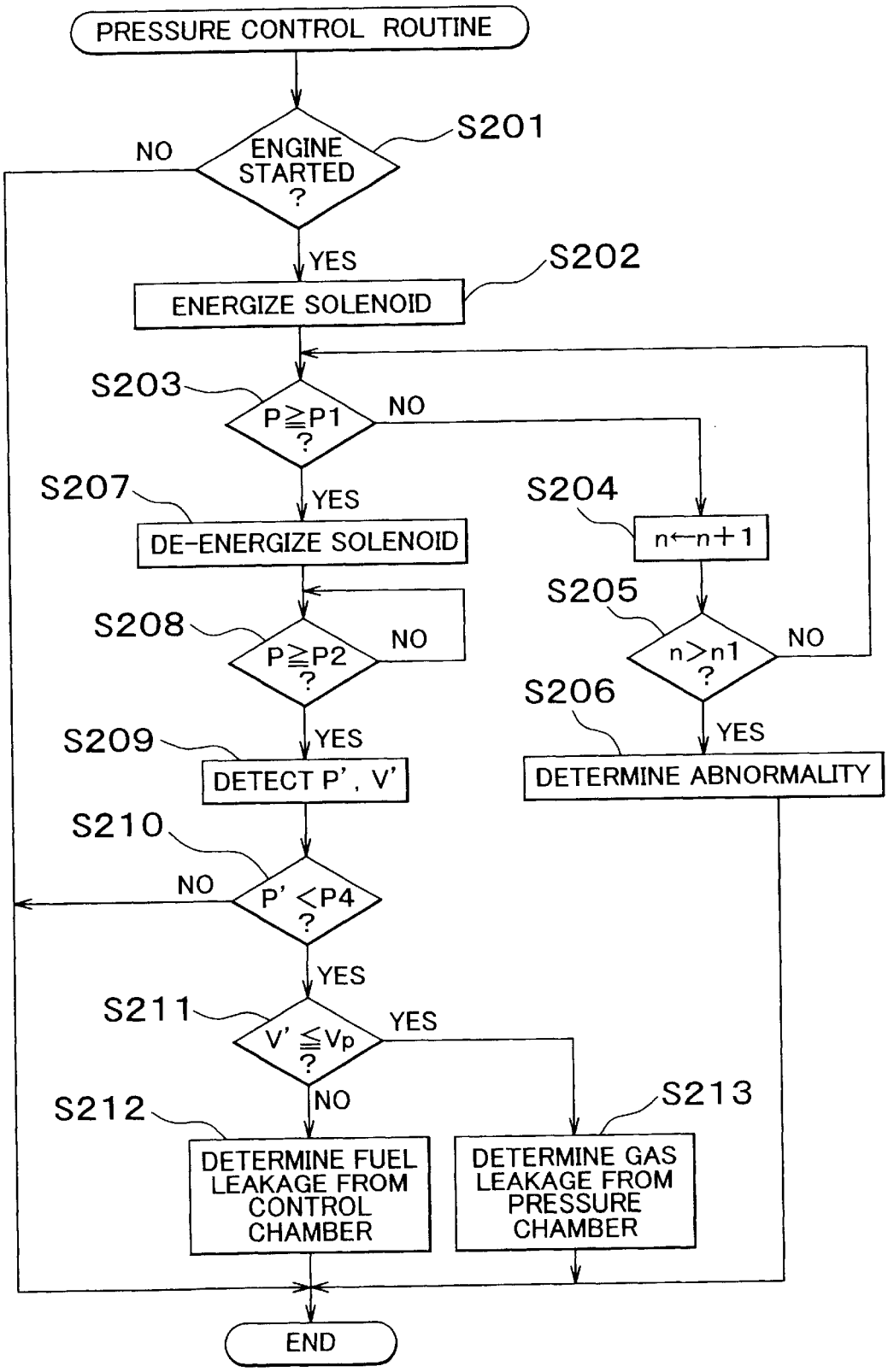
FIG. 5 is a flowchart illustrating a pressure control routine implemented by the high-pressure fuel supply system of the second embodiment of the invention.

The high-pressure fuel supply system constructed as described above is controlled upon a start of the engine according to a pressure control routine as illustrated in FIG. 5. In step 201, it is determined whether the engine has been started, depending upon the presence of an ON signal of the ignition switch. If a negative decision (NO) is obtained in step 201, the current cycle of the control routine is terminated. If an affirmative decision (YES) is obtained in step 201, the solenoid 20*e* is energized and the valve member 20*c* is placed in the open position in step 202. As a result, the piston 20*f* displaces or moves from the original position due to the pressure within the pressure chamber 20*g* of the accumulator 20*b,* so as to reduce the volume of the control chamber 20*a,* i.e., the volume of the high-pressure portion of the high-pressure fuel supply system. Here, the high-pressure portion is located downstream of the high-pressure pump 7 (or downstream of the check valve 8*a* when it is disposed on the delivery side of the high-pressure pump 7). With the displacement of the piston 20*f,* the fuel in the high-pressure portion including the delivery chamber 2 is compressed, so that the pressure of the fuel is raised to be higher than the delivery pressure of the low-pressure pump 4. Thus, an end face of the piston 20*f* that faces the control chamber 20*a* functions as a pressure wall for raising the fuel pressure in the high-pressure portion. The pressure wall is displaceable or movable over a displacement range between an original position at which the pressure within the pressure chamber 20*g* is approximately equal to the target fuel pressure, and a maximum displacement position at which the pressure within the pressure chamber 20*g* is approximately equal to, for example, the set pressure P1. In the case where a diaphragm is used in place of the piston, the diaphragm, which is elastically deformable, has a similar displacement range from the original position to the maximum displacement position.

In step 203, it is determined whether the fuel pressure P in the high-pressure portion detected by the pressure sensor 5 has reached the set pressure P1. If a negative decision (NO) is obtained in step 203, a count value n, which was reset to 0 when the engine was last stopped, is incremented by 1 in step 204. In step 205, it is determined whether the count value n has reached a set period n1. If a negative decision (NO) is obtained in step 205, control returns to step 203. When the pressure raising mechanism 20 operates normally, the fuel pressure P in the high-pressure portion reaches the set pressure P1 before the count value n reaches the set period n1, and an affirmative decision (YES) is obtained in step 203. In this case, the solenoid 20*e* is de-energized in step 207, so that the valve member 20*c* is displaced or moved under the biasing force of the spring 20*d* so as to close the opening 2*b*' that faces the delivery chamber 2. Since the opening 2*b*' closed by the valve member 20*c* has a suitably reduced size, the fuel pressure in the delivery chamber 2 does not rapidly increase upon opening of the valve including the valve member 20*c,* thus permitting the pressure control as described above.

At a point of time at which the fuel pressure P in the high-pressure portion reaches the set pressure P1, the gas pressure in the pressure chamber 20*g* of the accumulator 20*b* becomes equal to a pressure P4 (FIG. 6) that is higher than the set pressure P1, and the piston 20*f* has displaced over a half or less of its displacement range.

Since the fuel pressure in the high-pressure portion reaches the set pressure P1 that is significantly higher than the rated delivery pressure of the low-pressure pump 4 upon a start of the engine, desirable fuel injection can be achieved immediately after the engine is started, thus assuring a reliable engine start. As the speed of revolution of the engine increases, the high-pressure pump 7 is brought into a good operating condition, so that the fuel pressure in the high-pressure portion further increases, and is then maintained at around the target fuel pressure P2.

Figure 6:
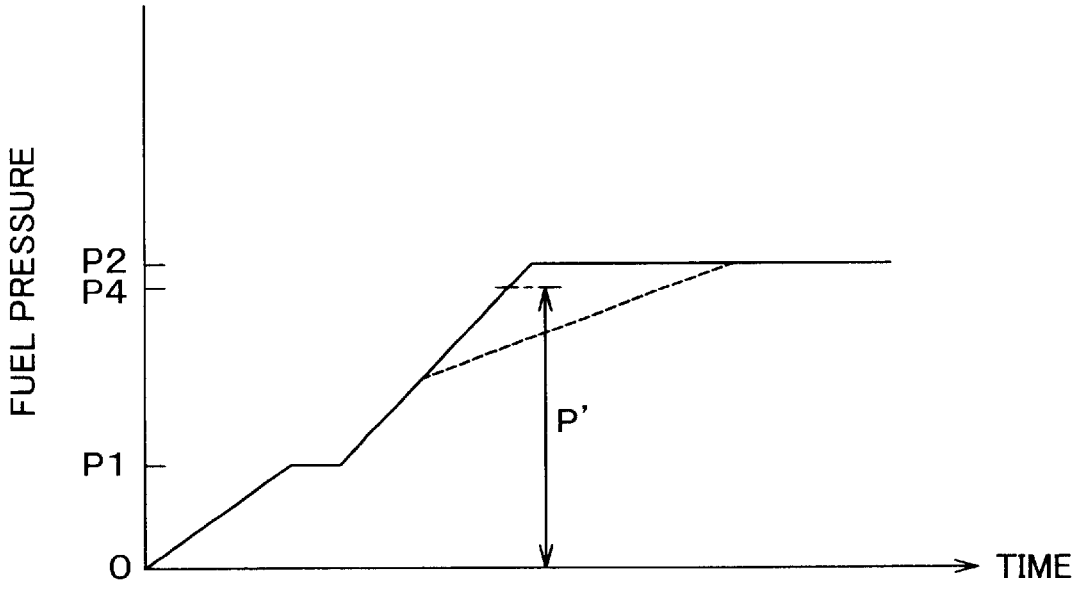
FIG. 6 is a time chart showing pressure changes in a high-pressure portion of the high-pressure fuel supply system of the second embodiment when the engine is started.

When the fuel pressure P reaches the target fuel pressure P2, an affirmative decision (YES) is obtained in step 208, and step 209 is executed to detect a pressure P' at which fuel starts flowing from the high-pressure portion into the accumulator 20*b,* and a quantity of fuel V' that flows into the accumulator 20*b*. The pressure P' will be hereinafter called "inflow pressure P'", and the quantity of the fuel V' will be called "inflow fuel quantity V'". FIG. 6 shows changes in the fuel pressure P in the high-pressure portion of the fuel supply system during a starting period of the engine. As shown in FIG. 6, the fuel pressure P is raised to the set pressure P1 by the pressure raising mechanism 20, and is then raised to the target fuel pressure P2 by the high-pressure pump 7 that is driven in accordance with the operation of the engine. The fuel pressure P generally increases from the set pressure P1 to the target fuel pressure P2 in a relatively short time after the engine is started, and the engine is kept idling during this time period. Accordingly, the quantity of fuel injected into the cylinders is kept almost constant, and a difference between the quantity of fuel that is fed under pressure from the high-pressure pump 7 to the high-pressure portion in a single operation of the pump and the quantity of fuel supplied to the cylinders is kept constant. This difference corresponds to the quantity of fuel that is accumulated in the delivery chamber 2, which leads to an increase in the pressure of the high-pressure portion. Assuming that the fuel is delivered from the high-pressure pump 7 at predetermined time intervals, the amount of a pressure increase in the high-pressure portion per unit time is constant. In other words, the pressure in the high-pressure portion increases linearly on average with respect to time.

If the fuel pressure in the high-pressure portion exceeds the current gas pressure P4 of the accumulator 20*b,* however, the valve member 20*c* is brought into the open position (i.e., is moved away from the opening 2*b*'), and fuel starts being introduced from the high-pressure portion into the accumulator 20*b.* As a result, the piston 20*f* is pushed back toward the original position so that the gas pressure in the pressure chamber 20*g* of the accumulator 20*b* becomes substantially equal to the fuel pressure in the high-pressure portion. Thus, once the fuel pressure in the high-pressure portion exceeds the gas pressure P4, the rate of increase of the pressure in the high-pressure portion is reduced. The above-indicated inflow pressure P' at which the fuel starts flowing into the accumulator 20*b* is equivalent to the fuel pressure P4 at which the rate of increase of the pressure in the high-pressure portion starts being reduced.

If the valve member 20*c* is kept in the open position until the fuel pressure in the high-pressure portion becomes equal to the pressure in the pressure chamber 20*g* of the accumulator, the piston 20*f* is pushed back to the original position at which the pressure in the pressure chamber 20*g* is substantially equal to the target fuel pressure. If, however, the engine is stopped immediately after the start of the engine, the piston 20*f,* which has displaced so as to raise the fuel pressure in the high-pressure portion to the set pressure P1, fails to return to the original position. In this condition, if the valve member 20*c* is brought into the open position when the engine is re-started, the piston 20*f* (or the accumulator 20*b*) may not be able to operate to raise the fuel pressure in the high-pressure portion to the set pressure P1. According to the present embodiment, on the other hand, the piston 20*f* is able to displace over at least the remaining half of the displacement range even if the engine was stopped immediately after a start of the engine and the piston 20*f* is located midway in the displacement range. Thus, if the valve member 20*c* is brought into the open position upon a start of the engine, the fuel pressure in the high-pressure portion can be increased to almost the set pressure P1, thus assuring good starting characteristics.

If the fuel in the control chamber 20*a* leaks while the engine is stopped, the fuel pressure in the control chamber 20*a* is lowered, and the piston 20*f* of the accumulator displaces from the normal position to a certain point in the displacement range. This situation, however, is similar to the above-described situation in which the engine is re-started after the engine is stopped immediately after its start. Thus, the fuel supply system of the invention assures good engine starting characteristics even with leakage of the fuel from the control chamber 20*a.* Even if a gas leaks from the pressure chamber 20*g* of the accumulator 20*b,* the piston 20*f* of the accumulator hardly displaces from the original position, and is able to raise the pressure in the high-pressure portion upon a start of the engine provided that the gas pressure in the pressure chamber 20*g* at this time is higher than the set pressure P1. In this case, too, the fuel supply system assures good engine starting characteristics. Nevertheless, if a large quantity of fuel leaks from the control chamber 20*a,* the piston 20*f* displaces or moves up to the maximum displacement position, and is thus unable to increase the pressure in the high-pressure portion. If a large quantity of gas leaks from the pressure chamber 20*g,* the gas pressure in the pressure chamber 20*g* becomes lower than the set pressure P1, thus making it impossible to raise the pressure in the high-pressure portion to the set pressure P1 upon a start of the engine. These abnormal operating conditions of the accumulator 20*b* can be determined in step 206 when an affirmative decision (YES) is obtained in step 205.

In order to determine fuel leakage or gas leakage that does not affect a pressure rise in the high-pressure portion to the set pressure P1, it is determined in step 210 whether the above-indicated inflow pressure P' at which the fuel starts flowing into the accumulator 20*b* is lower than the predetermined pressure P4. If there is fuel leakage from the control chamber 20*a* or gas leakage from the pressure chamber 20*g,* the gas pressure in the pressure chamber 20*g* of the accumulator 20*b* at a point of time when the fuel pressure in the high-pressure portion has reached the set pressure P1 upon a start of the engine is lower than that in the case where there is no fuel leakage or gas leakage. Since this gas pressure in the pressure chamber 20*g* corresponds to the inflow pressure at which the fuel starts flowing into the accumulator, the inflow pressure is lowered if any fuel leakage or gas leakage occurs. If a negative decision (NO) is obtained in step 210, the current cycle of the control routine is terminated. If an affirmative decision (YES) is obtained in step 210, it is determined that fuel leakage or gas leakage occurs, and control proceeds to step 211.

In step 211, it is determined whether the quantity of fuel V' that enters the accumulator 20*b* is equal to or smaller than a predetermined fuel quantity Vp that is determined with respect to the inflow pressure P'. If fuel leaks from the control chamber 20*a* or gas leaks from the pressure chamber 20*g,* the inflow pressure P' at which the rate of increase of the pressure in the high-pressure portion starts being reduced after a start of the engine is reduced, as indicated by a broken line in FIG. 6. The fuel quantity V' represents a quantity of fuel that flows into the accumulator during a period of time in which the fuel pressure in the high-pressure portion increases from the thus reduced inflow pressure P' to the target fuel pressure P2. In other words, the quantity of fuel V' is required for the pressure in the pressure chamber 20*g* of the accumulator 20*b* to increase from the inflow pressure P' to the target fuel pressure P2. More specifically, the quantity of fuel V' is calculated by subtracting the quantity of fuel consumed by the fuel injectors and the quantity of fuel required for increasing the pressure in the high-pressure portion from the inflow pressure P' to the target fuel pressure P2, from the quantity of fuel delivered from the high-pressure pump under pressure. The predetermined fuel quantity Vp is the required quantity of fuel to be introduced into the accumulator or a value obtained by adding calculation errors to this required quantity of fuel, when the pressure at which the fuel starts flowing into the accumulator is lowered from a normal level (P4) to the pressure level P' due to gas leakage from the pressure chamber 20*g.* The predetermined quantity of fuel Vp varies with respect to each inflow pressure at which the fuel starts flowing into the accumulator. If the inflow pressure is lowered from the normal level to the same pressure level P' due to fuel leakage from the control chamber 20*a,* the required quantity of fuel at the inflow pressure P' exceeds the predetermined quantity of fuel Vp.

In the equations (1), (2) as follows, V1 denotes a volume of the pressure chamber 20*g* at the inflow pressure P' when gas leaks from the pressure chamber 20*g*, and V2 denotes a volume of the pressure chamber 20*g* at the inflow pressure P' when fuel leaks from the control chamber 20*a*, while α1 and α2 denote the quantities of fuel flowing into the accumulator in the respective cases. The equations (1) and (2) are established according to the Boyle's law, assuming that the volume of the pressure chamber 20*g* is changed at a constant temperature.

$$P'\cdot V1=P2(V1-\alpha 1) \quad (1)$$

$$P'\cdot V2=P2(V2-\alpha 2) \quad (2)$$

where P2 is the target fuel pressure.

From the above equations (1) and (2), α1 and α2 are expressed as in the following equations (3) and (4).

$$\alpha 1=V1(P2-P')/P2 \quad (3)$$

$$\alpha 2=V2(P2-P')/P2 \quad (4)$$

It will be understood from the above relationships that the difference between the quantity of fuel α1 and the quantity of fuel α2 in the respective cases is only based on the difference between the volume V1 and the volume V2 of the pressure chamber 20*g* at the same inflow pressure P' at which the fuel starts flowing into the accumulator.

The value of P'·V1 obtained when gas leaks from the pressure chamber 20*g* is smaller than the value of P'·V2 obtained when no gas leakage occurs, which means that the relationship of V1<V2 is established. Thus, at the same pressure P' at which the fuel starts flowing into the accumulator, the quantity of fuel α2 flowing into the accumulator in which fuel leaks from the control chamber 20*a* is larger than the quantity of fuel α1 flowing into the accumulator in which gas leaks from the pressure chamber 20*g*. When a negative decision (NO) is obtained in step 211 therefore, control proceeds to step 212 to determine that fuel leaks from the control chamber 20*a*. If an affirmative decision (YES) is obtained in step 211, control proceeds to step 213 to determine that gas leaks from the pressure chamber 20*g*. Thus, different alarms can be generated to the driver upon occurrence of the respective types of abnormalities, thus making it easy to repair the accumulator 20*b*. As with the first embodiment, an ECU 100 executes the routine illustrated by the FIG. 5 flowchart, and functions to perform the above-described diagnoses.

Since the fuel is also compressed depending upon the pressure, the above-indicated quantity of fuel entering the accumulator is preferably calculated, for example, in terms of the target fuel pressure P2, while taking account of the bulk or volume modulus of the fuel.

In the second embodiment as described above, when the engine is restarted after the engine is stopped before the piston 20*f* of the accumulator 20*b* serving as a pressure wall of the pressure raising mechanism is returned to the original position, the accumulator piston 20*f* can normally displace from the current position to the desired position. Also, the presence of an abnormality, such as fuel or gas leakage, in the pressure raising mechanism can be determined, so that undesirable or abnormal operations of the accumulator piston can be avoided in advance through repair, or the like.

When the engine operates at a high load, and a large quantity of fuel is injected from the fuel injectors, in particular, a large quantity of fuel is delivered from the high-pressure pump, and the fuel pressure in the high-pressure portion of the fuel supply system varies relatively largely due to flow of the large amount of fuel into and out of the high-pressure portion. The large variations in the pressure result in a reduction in the accuracy with which the quantity of fuel injected into the cylinders is controlled by adjusting the time or period of opening of the fuel injection valves. In the present embodiment in which the accumulator as the pressure raising mechanism is connected to the high-pressure portion or delivery chamber, the pressure variations can be reduced by placing the valve member 20*c* in the open position, and utilizing changes in the volume of the accumulator pressure chamber 20*g*.

The fuel pressure in the high-pressure portion of the fuel supply system need not be always maintained at around the same target fuel pressure during an operation of the engine, but the target fuel pressure may be changed depending upon the desired quantity of fuel injection. For example, when only a small quantity of fuel is required, for example, during idling of the engine, the period of opening of each fuel injection valve is minimized. However, if the pressure in the high-pressure portion is high in this situation, an unnecessarily large quantity of fuel may be injected, resulting in an increase in the fuel consumption (i.e., reduced fuel economy). It is therefore preferable to reduce the target fuel pressure of the high-pressure portion during idling of the engine.

Thus, a selected one of two target fuel pressures, i.e., a relatively high target fuel pressure and a relatively low target fuel pressure, may be used as the target fuel pressure of the high-pressure portion. If the accumulator is connected to the high-pressure portion as in the illustrated embodiments, the valve member 20*c* is placed in the closed (valve-closing) position under the biasing force of the spring 20*d* when the relative low target pressure is to be established, and the valve body 20*c* is placed in the open (valve-opening) position through energization of the solenoid 20*e* when the relatively high target pressure is to be established. Thus, the valve member 20*c* is brought into the closed position (i.e., the opening 2*b*' is closed) when the relatively low target fuel pressure is established, so that the relatively high target pressure that was established before is accumulated in the accumulator 20*b*. In order to control the fuel pressure in the high-pressure portion to the relatively low target pressure, the fuel delivery from the high-pressure pump 7 is stopped, and fuel injection is carried out. At this time, the valve member 20*c* is placed in the closed position, and the volume of the control chamber 20*a* is excluded from the volume of the high-pressure portion of the fuel supply system, thus permitting a quick reduction in the pressure in the high-pressure portion.

In order to control the pressure in the high-pressure portion to the relatively high target pressure, the high-pressure pump 7 is caused to deliver the maximum quantity of the fuel. In addition, the valve member 20*c* is placed in the open position (i.e., the opening 2*b*' is opened) so that the pressure accumulating function of the accumulator can be utilized for increasing the pressure in the high-pressure portion. Thus, the pressure in the high-pressure portion can be quickly increased to the relatively high target pressure.

While the high-pressure portion of the high-pressure fuel supply system of each of the first and second embodiments includes the delivery chamber (2), the invention may also be applied to a fuel supply system in which a fuel pump as a high-pressure pump and each of fuel injectors are directly connected to each other by a high-pressure pipe as in a general diesel engine, with no delivery chamber provided between the fuel pump and the fuel injectors. In this case, too, the pressure in the high-pressure pipe can be sufficiently raised upon a start of the engine, thus permitting reliable fuel injection while at the same time assuring good engine starting characteristics.

In the first embodiment and second embodiment, the pressure wall of the plunger, piston, or the like, is designed to displace over only a half of the displacement range during a starting period of the engine. However, the pressure wall may displace, for example, over only one-third or one-fourth of the displacement range. Thus, the displacement of the pressure wall may be set as desired provided that the engine can be re-started in a desirable manner after the engine is stopped immediately after the engine is started at least once.

In the illustrated embodiment, the controller (the ECU 100) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hard-wired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A high-pressure fuel supply system for an internal combustion engine, comprising:

a pressure raising mechanism that is operable to raise a pressure in a high-pressure portion of the fuel supply system to a first level during a start of the internal combustion engine, the pressure raising mechanism comprising a pressure wall that is displaceable from an original position so as to reduce a volume of the high-pressure portion and thereby raise the pressure in the high-pressure portion, the pressure wall being displaceable in a predetermined displacement range between the original position and a maximum displacement position; and a high-pressure pump that is operable to raise the pressure in the high-pressure portion of the fuel supply system to a second level that is higher than the first level after the start of the internal combustion engine, the pressure wall being returned to the original position while the pressure in the high-pressure portion is raised by the high-pressure pump to the second level, wherein the pressure wall is spaced apart from the maximum displacement position of the predetermined displacement range when the pressure in the high-pressure portion that is raised by the pressure raising mechanism reaches the first level, so that the pressure wall is able to further displace toward the maximum displacement position so as to raise the pressure in the high-pressure portion when the internal combustion engine is re-started after the engine is stopped before the pressure wall is returned to the original position.

2. The high-pressure fuel supply system according to claim 1, wherein the pressure wall is located at about a half point in the predetermined displacement range when the pressure in the high-pressure portion reaches the first level.

3. The high-pressure fuel supply system according to claim 1, further comprising:

a fuel tank that contains the fuel; and a low-pressure pump disposed between the fuel tank and the high-pressure pump, the low-pressure pump being operable to raise a pressure of the fuel from the fuel tank to a rated delivery pressure.

4. The high-pressure fuel supply system according to claim 1, wherein the pressure raising mechanism comprises a plunger assembly including a first end face as the pressure wall and a second end face having a larger cross-sectional area than the first end face, the second end face receiving a pressure from a low-pressure portion of the fuel supply system that is located upstream of the high-pressure pump so that the first end face as the pressure wall displaces from the original position.

5. The high-pressure fuel supply system according to claim 4, further comprising:

a fuel tank that contains the fuel; and a low-pressure pump disposed between the fuel tank and the high-pressure pump, the low-pressure pump being operable to raise a pressure of the fuel from the fuel tank to a rated delivery pressure, wherein the second end face of the plunger assembly receives the rated delivery pressure, so that the first end face as the pressure wall displaces from the original position so as to reduce the volume of the high-pressure portion.

6. The high-pressure fuel supply system according to claim 4, wherein the plunger assembly comprises a first plunger having the first end face as the pressure wall, and a second plunger having the second end face, and wherein the first plunger protrudes into the high-pressure portion by a variable length in accordance with the pressure applied from the low-pressure portion to the second end face of the second plunger.

7. The high-pressure fuel supply system according to claim 1, wherein the pressure raising mechanism comprises an accumulator including a displaceable member having the pressure wall, the accumulator including a pressure chamber that contains a gas, and a control chamber that contains the fuel and is connected with the high-pressure portion via a valve device.

8. The high-pressure fuel supply system according to claim 7, wherein the displaceable member comprises a piston.

9. The high-pressure fuel supply system according to claim 7, wherein the valve device comprises a valve member that is placed in a selected one of an open position in which the control chamber communicates with the high-pressure portion, and a closed position in which the control chamber is shut off from the high-pressure portion, the valve device further comprising a spring that biases the valve member toward the closed position, and a solenoid that places the valve member into the open position when energized.

10. The high-pressure fuel supply system according to claim 1, further comprising a controller that diagnoses the pressure raising mechanism based on changes in the pressure in the high-pressure portion during an operation of the high-pressure pump.

11. A high-pressure fuel supply system for an internal combustion engine, comprising:

a pressure raising mechanism that is operable to raise a pressure in a high-pressure portion of the fuel supply system to a first level during a start of the internal combustion engine, the pressure raising mechanism comprising a pressure wall that is displaceable from an original position so as to reduce a volume of the high-pressure portion and thereby raise the pressure in the high-pressure portion, the pressure wall being displaceable in a predetermined displacement range between the original position and a maximum displacement position;

a high-pressure pump that is operable to raise the pressure in the high-pressure portion of the fuel supply system to a second level that is higher than the first level after the start of the internal combustion engine, the pressure wall being returned to the original position while the pressure in the high-pressure portion is raised by the high-pressure pump to the second level; and a controller that diagnoses the pressure raising mechanism based on changes in the pressure in the high-pressure portion during an operation of the high-pressure pump.

12. A high-pressure fuel supply system according to claim 11, wherein the controller diagnoses the pressure raising mechanism based on a period of time that is required for the pressure in the high-pressure portion to be raised to the first level.

13. A high-pressure fuel supply system according to claim 11, wherein the controller diagnoses the pressure raising mechanism based on at least one of a return pressure at which the pressure wall is returned to the original position, and a return period during which the pressure in the high-pressure portion is kept at the return pressure.

14. A high-pressure fuel supply system according to claim 11, wherein the pressure raising mechanism comprises an accumulator including a displaceable member having the pressure wall, the accumulator including a pressure chamber that contains a gas, and a control chamber that contains the fuel and is connected with the high-pressure portion via a valve device.

15. A high-pressure fuel supply system according to claim 14, wherein the controller determines leakage of the gas from the pressure chamber or leakage of the fuel from the control chamber based on an inflow pressure at which the fuel starts flowing into the accumulator during a time in which the pressure in the high-pressure portion is raised from the first level to the second level.

16. A high-pressure fuel supply system according to claim 15, wherein the controller determines leakage of the gas from the pressure chamber or leakage of the fuel from the control chamber based on a quantity of the fuel that flows into the accumulator during a time in which the pressure in the high-pressure portion is raised from the inflow pressure to the second level.

17. A method of controlling a high-pressure fuel supply system for an internal combustion engine, the high-pressure fuel supply system including (a) a pressure raising mechanism that is operable to raise a pressure in a high-pressure portion of the fuel supply system to a first level during a start of the internal combustion engine, the pressure raising mechanism comprising a pressure wall that is displaceable from an original position so as to reduce a volume of the high-pressure portion and thereby raise the pressure in the high-pressure portion, the pressure wall being displaceable in a predetermined displacement range between the original position and a maximum displacement position, and (b) a high-pressure pump that is operable to raise the pressure in the high-pressure portion of the fuel supply system to a second level that is higher than the first level after the start of the internal combustion engine, the pressure wall being returned to the original position while the pressure in the high-pressure portion is raised by the high-pressure pump to the second level, the method comprising:

causing the pressure wall to be spaced apart from the maximum displacement position of the predetermined displacement range when the pressure in the high-pressure portion that is raised by the pressure raising mechanism reaches the first level, so that the pressure wall is able to further displace toward the maximum displacement position so as to raise the pressure in the high-pressure portion when the internal combustion engine is re-started after the engine is stopped before the pressure wall is returned to the original position.

18. The method according to claim 17, further comprising diagnosing the pressure raising mechanism based on changes in the pressure in the high-pressure portion during an operation of the high-pressure pump.

19. A method of controlling a high-pressure fuel supply system for an internal combustion engine, the high-pressure fuel supply system including (a) a pressure raising mechanism that is operable to raise a pressure in a high-pressure portion of the fuel supply system to a first level during a start of the internal combustion engine, the pressure raising mechanism comprising a pressure wall that is displaceable from an original position so as to reduce a volume of the high-pressure portion and thereby raise the pressure in the high-pressure portion, the pressure wall being displaceable in a predetermined displacement range between the original position and a maximum displacement position, and (b) a high-pressure pump that is operable to raise the pressure in the high-pressure portion of the fuel supply system to a second level that is higher than the first level after the start of the internal combustion engine, the pressure wall being returned to the original position while the pressure in the high-pressure portion is raised by the high-pressure pump to the second level, the method comprising:

diagnosing the pressure raising mechanism based on changes in the pressure in the high-pressure portion during an operation of the high-pressure pump.

20. A method according to claim 19, wherein the step of diagnosing the pressure raising mechanism is based on a period of time that is required for the pressure in the high-pressure portion to be raised to the first level.

21. A method according to claim 19, wherein the step of diagnosing the pressure raising mechanism is based on at least one of a return pressure at which the pressure wall is returned to the original position, and a return period during which the pressure in the high-pressure portion is kept at the return pressure.

* * * * *